US008286731B2

(12) United States Patent
Ressi di Cervia

(10) Patent No.: US 8,286,731 B2
(45) Date of Patent: Oct. 16, 2012

(54) METHOD AND APPARATUS FOR CONSTRUCTING DEEP VERTICAL BOREHOLES AND UNDERGROUND CUT-OFF WALLS

(76) Inventor: Arturo L. Ressi di Cervia, New York, NY (US)

( * ) Notice: Subject to any disclaimer, the term of this patent is extended or adjusted under 35 U.S.C. 154(b) by 288 days.

(21) Appl. No.: 12/588,603

(22) Filed: Oct. 21, 2009

(65) Prior Publication Data

US 2010/0108392 A1 May 6, 2010

Related U.S. Application Data

(60) Provisional application No. 61/193,007, filed on Oct. 22, 2008, provisional application No. 61/193,104, filed on Oct. 29, 2008, provisional application No. 61/193,458, filed on Dec. 2, 2008, provisional application No. 61/193,490, filed on Dec. 3, 2008.

(51) Int. Cl.
*E21B 7/00* (2006.01)

(52) U.S. Cl. ..... 175/57; 175/386; 175/171; 175/257; 405/267

(58) Field of Classification Search ..... 175/57, 175/171, 257, 262, 385, 386; 405/267, 233, 405/235, 236, 237
See application file for complete search history.

(56) References Cited

U.S. PATENT DOCUMENTS

| | | | | |
|---|---|---|---|---|
| 2,046,106 A | | 6/1936 | Bozeman | |
| 2,791,886 A | * | 5/1957 | Veder | 405/267 |
| 3,227,230 A | | 1/1966 | Lagerstrom | |
| 3,310,952 A | | 3/1967 | Veder | |
| 3,489,219 A | * | 1/1970 | Higgins | 166/253.1 |
| 3,645,101 A | | 2/1972 | Sherard | |
| 3,690,109 A | * | 9/1972 | Lee | 405/241 |
| 3,703,212 A | * | 11/1972 | Abrahams | 175/173 |
| 3,969,902 A | * | 7/1976 | Ichise et al. | 405/267 |
| 4,005,582 A | | 2/1977 | Tamaro | |
| 4,031,974 A | | 6/1977 | Peterson | |
| 4,182,422 A | | 1/1980 | Youngblood et al. | |
| 4,506,931 A | * | 3/1985 | Haspert | 299/1.3 |
| 4,852,672 A | | 8/1989 | Behrens | |
| 5,056,242 A | | 10/1991 | Miotti | |

(Continued)

OTHER PUBLICATIONS

Article entitled "Secant Pile Wall Retaining Systems for Deep Excavation" from *Deep Excavation*, 2 pages, Copyright 2006.

*Primary Examiner* — Giovanna Wright
*Assistant Examiner* — Richard Alker
(74) *Attorney, Agent, or Firm* — Bacon & Thomas, PLLC

(57) ABSTRACT

A method and apparatus for constructing large vertical boreholes and underground cut-off walls is disclosed. A drill rig assembly with double rotary heads drives a small diameter drill string and a much larger diameter drill string which is concentric with the smaller drill string and has a donut shaped drill bit configuration at the lower end thereof. Preferably, a steerable mud motor/drill is provided on one end of the small drill string and is guided to make as vertical a borehole as possible. In a preferred embodiment, the small inner drill is advanced to the full depth using the steerable mud motor/drill to achieve a high degree of verticality and a slight smaller casing is installed and used as a verticality guide for the much larger diameter outer drill string. In a further embodiment, the inner drill string is advanced a predetermined distance, then the outer string is advanced using the inner string as a verticality guide, these steps being repeated in alternating fashion to the final depth.

3 Claims, 9 Drawing Sheets

U.S. PATENT DOCUMENTS

| | | | | |
|---|---|---|---|---|
| 5,311,954 | A | 5/1994 | Quintana | |
| 5,451,126 | A | 9/1995 | Brun | |
| 6,065,550 | A | 5/2000 | Gardes | |
| 6,164,873 | A | 12/2000 | Miotti et al. | |
| 6,848,518 | B2 | 2/2005 | Chen et al. | |
| 7,234,543 | B2 | 6/2007 | Schaaf | |
| 7,506,700 | B1 | 3/2009 | Harvey et al. | |
| 2005/0274547 | A1 * | 12/2005 | Fincher et al. | 175/57 |

* cited by examiner

METHOD AND APPARATUS FOR CONSTRUCTING DEEP VERTICAL BOREHOLES AND UNDERGROUND CUT-OFF WALLS

REFERENCE TO RELATED APPLICATIONS

This application claims the benefit of U.S. Provisional Application No. 61/193,007, entitled "Method for the Construction of a Cut-off Wall", filed Oct. 22, 2008; U.S. Provisional Application No. 61/193,104, entitled "Method and Apparatus for Constructing Deep Bore Holes and Underground Walls", filed Oct. 29, 2008; U.S. Provisional Application No. 61/193,458, entitled "Method and Apparatus for Constructing Deep Bore Holes and Underground Walls", filed Dec. 2, 2008; and U.S. Provisional Application No. 61/193,490, entitled "Method and Apparatus for Constructing Deep Bore Holes and Underground Walls", filed Dec. 3, 2008, which are incorporated herein by reference.

BACKGROUND AND BRIEF DESCRIPTION OF THE INVENTION

The present invention is in the field of vertical underground boreholes and vertical underground cut-off walls.

Methods for the construction of watertight cut-off walls in the ground are already known, for example for the construction of cut-off walls, which eliminate the necessity of expensive draining and sealing operations during excavations, especially in alluvial grounds. For example, see Veder U.S. Pat. No. 2,791,886, incorporated herewith by reference.

Prior art cut-off walls do not always ensure the desired water tightness. The reason for this is partly because it is difficult to obtain a perfect interlocking or interengagement of the single elements, partly because ordinary methods of drilling by means of boring tubes do not guarantee a perfect verticalness of the final wall so that supplementary injection operations are necessary in order to consolidate the wall and to fill in the empty spaces.

The purpose of a cut-off wall for a dam is to intercept the venues of seepage and eliminate them by constructing a permanent positive barrier.

The barrier should have the capacity of accommodating small movements which will occur during the raising and lowering of the reservoir level, thus it should preferably be built with plastic concrete.

Two major concerns must be addressed by the methodology of constructing the wall:

stability of the excavation when seepage areas are encountered;

continuity and minimum section of the wall at the joints.

The first concern can be solved by utilizing a secant-wall method, which minimizes the size of the open excavation and enhances its stability by the arching effect of the round holes.

The second concern is harder to satisfy, but the problem is solved by using the double stage drilling system of the present invention.

The invention features the following:

A preferred embodiment of the system comprises using directional drilling techniques, commonly utilized in the oil field industry, to drill a relatively small (e.g. 12¼") hole to full depth of the cut-off wall with a proven accuracy of ¼ degree at 10,000'. At the cut-off wall depth of 700' for example, this translates to less than ½". Even accounting for instrumentation and operator errors, it is safe to assume that the bottom of the hole will be within a one foot diameter of the true center.

The small hole is drilled with steerable mud motor/drills, using bentonite as fluid. Once the small hole is drilled and stabilized with a proper mud system, the drill string will be extracted and a casing of 12" or less will be run to full depth of the smaller hole.

This will act as the guide for the drilling of a much larger (e.g. 36"-48") hole (e.g. depending on field tests), using a doughnut shaped bit. The drilling of the larger hole be done under bentonite mud using either direct or reverse circulation.

It is important to note the limited size of the open hole, drilled in a ground already partially stabilized by the 12¼" previously drilled hole.

When this drilling is completed, the outer drill string is withdrawn and the plastic concrete is pumped from the bottom up using the 12" (or less) casing as the tremie pipe.

This wall will be constructed by alternating a series of primary piles and secondary secant ones; the diameter and spacing will be determined by field tests which will verify the accuracy of the drilling method.

A second preferred embodiment of the invention features a method of constructing an underground vertical hole in a selected location to a depth exceeding 100 feet comprising, (a) providing a drill string assembly comprised of outer and inner drill strings with the outer drill string having a central guiding hole for telescopingly receiving the inner drill string, said inner drill string having a steerable mud motor/drill at the lower end thereof, said outer drill string having one or more drill bits at the lower end thereof, drive mechanisms for the drill outer string, (b) lowering the drill string assembly in an optional starter casing and set it vertical, (c) advance the inner drill string to the full depth using the steerable mud motor/drill to assure verticality of said hole, (d) extracting the inner drill string and installing an inner casing to the full depth, (e) advance the outer drill string to said full depth using the inner casing as a verticality guide for said outer drill string.

A method of constructing an underground wall along a selected path and having predetermined deep depth comprising, (a) providing a drill string assembly comprised of outer and inner drill strings with the outer drill string having a central guiding borehole for telescopingly receiving the inner drill string, said inner drill string having a steerable mud motor/drill at the lower end thereof, said outer drill string having one or more drill bits at the lower end thereof, and drive a mechanism for the outer drill string, (b) advance the inner drill string to the full predetermined depth of the wall using the steerable mud motor/drill to assure verticality to the full depth of said wall, (c) extracting the inner drill string and installing an inner casing to the full depth, (d) advance the outer drill string to the full depth of said wall using the inner casing as a verticality guide for said outer drill string, (e) remove the drill string assembly and using the inner casing as a tremie pipe, fill the hole with a wall forming plastic concrete to form a first vertical wall element, (f) repeat the process along the selected wall path at a distance less than the diameter of the previously constructed element, (g) repeat the process in between the two previously completed elements, cutting into them to assure continuity of the wall.

Apparatus for excavating an underground borehole having a predetermined deep depth comprising, a drill string assembly having outer and inner drill strings with the outer drill string having a central guiding borehole for telescopingly receiving the inner drill string, said inner drill string having a steerable mud motor/drill at the lower end thereof, said outer drill string having one or more drill bits at the lower end thereof, respectively, and a separate drive head for said outer drill string.

A method of constructing an underground vertical hole in a selected location to a depth exceeding 100 feet comprising, (a) providing a drill string assembly comprised of outer and inner drill strings with the outer drill string having a central guiding borehole for telescopingly receiving the inner drill string, said inner drill string having a steerable mud motor/drill at the lower end thereof, said outer drill string having one or more drill bits at the lower end thereof, drive mechanisms for the drill outer string, (b) install a vertical starter casing at the selected location (optional), (c) lowering the drill string assembly in the starter casing and set it vertical, (d) advance the inner drill string to the full depth using the steerable mud motor/drill to assure verticality of said hole, (e) advance the outer drill string to said full depth using the inner drill string as a verticality guide for said outer drill string.

A method of constructing an underground wall along a selected path and having predetermined deep depth comprising, (a) providing a drill string assembly comprised of outer and inner drill strings with the outer drill string having a central guiding borehole for telescopingly receiving the inner drill string, said inner drill string having a steerable mud motor/drill at the lower end thereof, said outer drill string having one or more drill bits at the lower end thereof, and drive a mechanism for the outer drill string, (b) install a vertical starter casing in the path of the wall, (c) lowering the drill string assembly in the starter casing and set it vertical, (d) advance the inner drill string to the full depth of the wall using the steerable mud motor/drill to assure verticality to the full depth of said wall, (e) advance the outer drill string to the full depth of said wall using the inner drill string as a verticality guide for said outer drill string, (f) remove the drill string assembly and fill the hole with a wall forming material to form a first vertical wall element, (g) repeat the process along the selected wall path at a distance less than the diameter of the previously constructed element, (h) repeat the process in between the two previously completed elements, cutting into them to assure continuity of the wall.

A method of constructing a deep underground wall along a selected path comprising, (a) providing a drill string assembly comprised of outer and inner drill strings with the outer drill string having a central guiding borehole for telescopingly receiving the inner drill string, said inner drill string having a steerable mud motor/drill at the lower end thereof, said outer drill string having one or more drill bits at the lower end thereof, and a drive mechanism for said outer drill string, (b) install a vertical starter casing in the path of the wall, (c) lowering the drill string assembly in the starter casing and set it vertical, (d) advance the inner drill string for a predetermined distance using the steerable mud motor/drill to assure verticality to the full depth of said wall, (e) remove the drill string assembly and fill the hole with a wall forming material to form a first vertical wall element, (f) at a predetermined distance along the path of said wall repeating steps (b)-(g) to form a second vertical wall element, (g) excavating the earth between said first and second wall elements using said first and second elements as a guide to form a panel slot there between and filling said panel slot with a wall forming material, and (h) repeating steps (b)-(i) at least one further time positioned along the selected path of the wall at a distance less than the diameter of the drill holes, (i) create the connection between the two panels by forming a circular element in between them.

A method of constructing an underground vertical hole in a selected location to a depth exceeding 100 feet comprising, (a) providing a drill string assembly comprised of outer and inner drill strings with the outer drill string having a central guiding borehole for telescopingly receiving the inner drill string, each drill string having one or more drill bits at the lower end thereof, respectively, and drive mechanisms for the drill strings, (b) install a vertical starter casing at the selected location, (c) lowering the drill string assembly in the starter casing and set it vertical, (d) advance the inner drill string for a predetermined distance using the central guiding borehole in the outer drill string as a verticality guide, (e) advance the outer drill string for said predetermined distance using the inner drill string as a verticality guide, (f) repeat steps (c)-(e) to final depth, A method of constructing an underground wall along a selected path and having predetermined deep depth comprising, (a) providing a drill string assembly comprised of outer and inner drill strings with the outer drill string having a central guiding borehole for telescopingly receiving the inner drill string, each drill string having one or more drill bits at the lower end thereof, respectively, and drive mechanisms for the drill strings, (b) install a vertical starter casing in the path of the wall, (c) lowering the drill string assembly in the starter casing and set it vertical, (d) advance the inner drill string for a predetermined distance using the central guiding borehole in the outer drill string as a verticality guide, (e) advance the outer drill string for said predetermined distance using the inner drill string as a verticality guide, (f) repeat steps (c)-(e) to final depth, (g) remove the drill string assembly and fill the hole with a wall forming material to form a first vertical wall element, (h) repeat the process along the selected wall path at a distance less than the diameter of the previously constructed element, (i) repeat the process in between the two previously completed elements, cutting into them to assure continuity of the wall.

A method of constructing a deep underground wall along a selected path comprising (a) providing a drill string assembly comprised of outer and inner drill strings with the outer drill string having a central guiding borehole for telescopingly receiving the inner drill string, each drill string having one or more drill bits at the lower end thereof, respectively, and drive mechanisms for the drill strings, (b) install a vertical starter casing in the path of the wall, (c) lowering the drill string assembly in the starter casing and set it vertical, (d) advance the inner drill string for a predetermined distance using the central guiding borehole in the outer drill string as a guide, (e) advance the outer drill string for said predetermined distance using the inner drill string as a guide, (f) repeat steps (c)-(e) to final depth, (g) remove the drill string assembly and fill the hole with a wall forming material to form a first vertical wall element, (h) at a predetermined distance along the path of said wall repeating steps (b)-(g) to form a second vertical wall element, (i) excavating the earth between said first and second wall elements using said first and second elements as a guide to form a panel slot there between and filling said panel slot with a wall forming material, and (j) repeating steps (b)-(i) at least one further time positioned along the selected path of the wall at a distance less than the diameter of the drill holes, (k) create the connection between the two panels by forming a circular element in between them.

A wall constructed in accordance with a further feature of this invention consists of a series of substantially vertical cylindrical elements which intersect, interengage and adapt themselves to each other so as to form a single homogeneous mass. This is obtained by drilling a series of spaced circular or elongated holes, which holes are filled on the spot with cement or the like material carrying a magnetic additive.

Primary elements are formed by drilling one or more primary holes in spaced relation, and then filling these holes with concrete containing magnetic particles, in order to be able to drill intermediate holes intersecting or overlapping the concrete poles already present in the first mentioned primary hole or holes and the concrete then filled into the intermediate holes intimately binds itself to the concrete in the first mentioned primary holes.

The problem solved by this feature of the present invention is to verify a minimum section of overlap at the joint of two adjacent elements in deep cut offs. Briefly the problem can be solved as follows:

After the completed excavation of primary elements, be it in the form of circular piles or in elongated shapes excavated by Hydromills, the element is filled with concrete or plastic concrete containing in the mix a magnetic substance (iron filings, steel fibers, magnetite sand and the like or the equivalent).

After the excavation of the secondary element, which has accomplished the task of forming a joint with the primaries by removing a portion of the adjacent primaries, a borehole probe is lowered into the excavation which will record the portion of the periphery of the hole with magnetic reading.

Since alignment is not important in deep cut-offs, but only continuity and minimum section, orienting the probe is not critical, since as long as it reads two minimum overlaps in the adjacent primaries, the purpose of the cut-off is achieved. In the absence of two minimum overlaps, remedial action may be taken, such as enlarging the borehole for the secondary wall element to achieve the desired overlap or drill a further overlapping hole and fill with concrete to correct for the misalignment and eliminate the discontinuity.

By taking the readings at preset intervals, minimum overlap for the whole depth can be verified.

BRIEF DESCRIPTION OF THE DRAWINGS

The above and other obvious advantages and features of the invention will become more apparent when considered with the attached drawings wherein.

DETAILED DESCRIPTION OF THE INVENTION

Figure 1A:
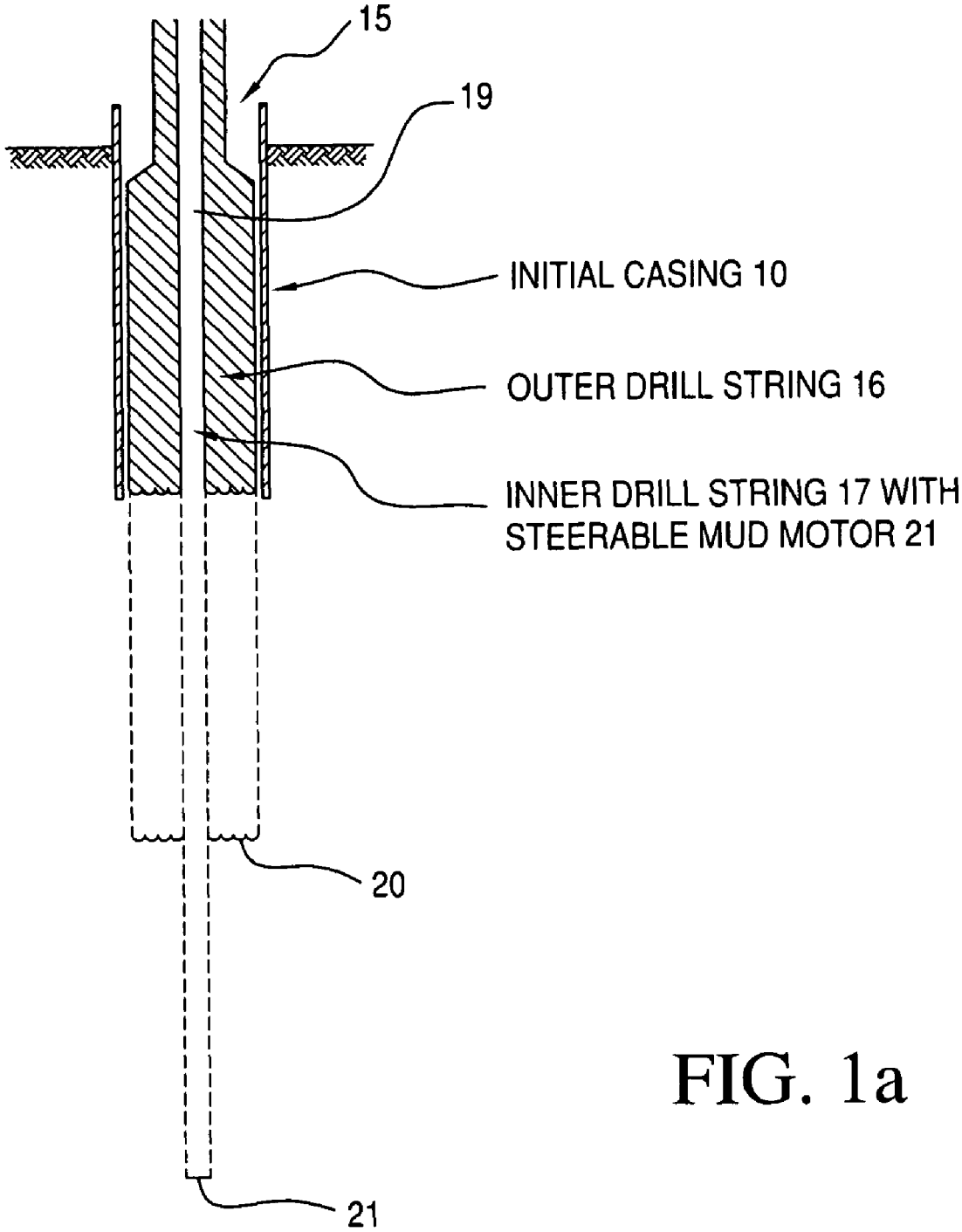
FIG. 1*a* is a schematic illustration of the fundamental aspects of the invention, FIG. 1*b* discloses the small diameter borehole with a casing therein and the large donut shaped drill bit being advanced to the full depth of the borehole.
Figure 1C:
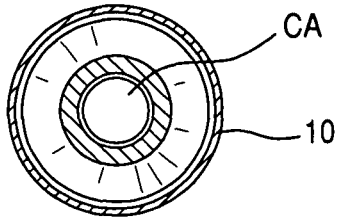
FIG. 1*c* is a sectional view on lines 1C-1C of FIG. 1*b*.
Figure 1B:
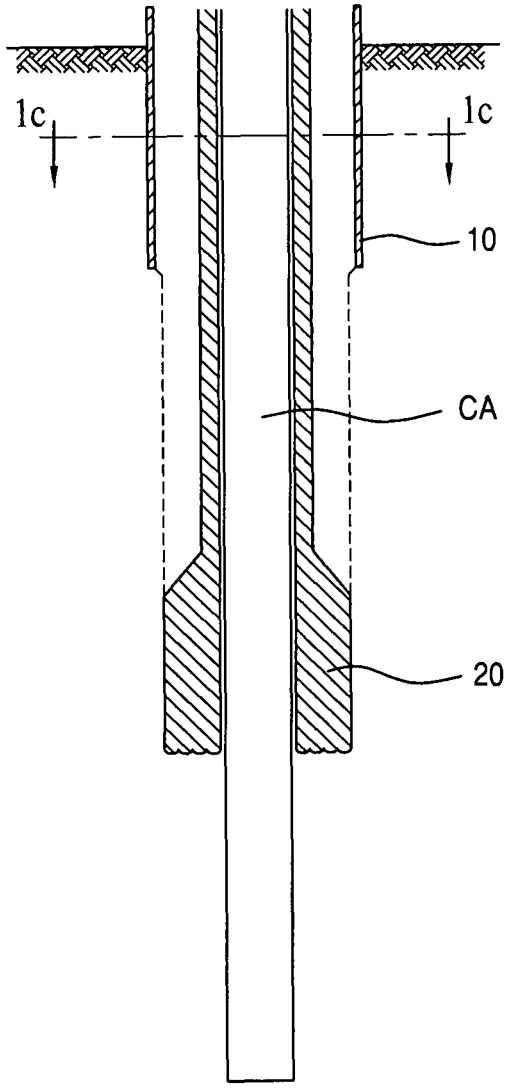

Referring now to FIGS. 1*a* and 1*b*, optionally, an initial cylindrical casing 10 is installed as the starter casing. It must be absolutely (straight) and then after it is placed it is emptied. Drill string assembly 15 comprised of a larger outer drill string 16 and smaller inner drill string 17 telescopically fitted in a bore 19 in the outer drill string 16. Outer drill string 16, which may be several feet in diameter (3-6 feet) has its own donut shaped drill bit array 20, at the lower end thereof. Inner drill string 17 is provided with a steerable mud motor/drill 21 (FIG. 2) which is commonly used in oil and gas well drilling and may be several inches in diameter (about 5-13 inches). Drill string assembly 15 is lowered in the cylindrical casing 10 and set vertical. The next step is the inner drill string 17 is advanced to the full depth, being guided by the steerable mud motor/drill 21. The inner and outer drill strings are provided with passages (see FIG. 8) for the circulation of selected drilling fluids which remove the cuttings to the surface. After the inner drill string 17 and steerable mud motor/drill 21 have been advanced to the final depth, it is withdrawn and replaced by an inner casing CA. Then the outer drill string 16 is advanced by its own drive head (not shown in FIG. 1 but see FIGS. 5, 6 and 7) all the while being guided by the pilot inner casing CA. The outer drill string 16 is withdrawn and the mud (bentonite) filled hole is filled with a plastic concrete using the pilot inner casing as a tremie pipe.

Summarizing

Step 1

Install a starter casing 10 absolutely straight and empty it.

Step II

Lower the drill string assembly in the hole and again set it vertical.

Step III

Advance inner drill string to the final depth using the steerable mud motor 21 to assure verticality, and replace with casing CA, FIG. 1*b*.

Step IV

Advance the outer drill string guided by the inner drill string.

Drilling by the outer drill string can be done by percussion, rotary percussion or rotary method with direct or reverse circulation using air or fluids. The inner casing CA and the hollow drill string 20 are operated by a drill rig with double rotary head which allows the holding of the inner casing CA while operating the outer drill string.

The drilling can be done with air or fluids, direct or reverse circulation depending on soil conditions.

The invention can be used to make single deep vent holes for ventilation shafts in deep tunnels, water intakes and the like, deep secant pile walls for cut-offs for dams and the like, and to make deep combination walls.

In order to build a continuous wall, first verify the maximum deviation of the drilling system and space primary holes guarantee minimum overlap of secondary holes assuming maximum deviation at full depth.

Figure 2:
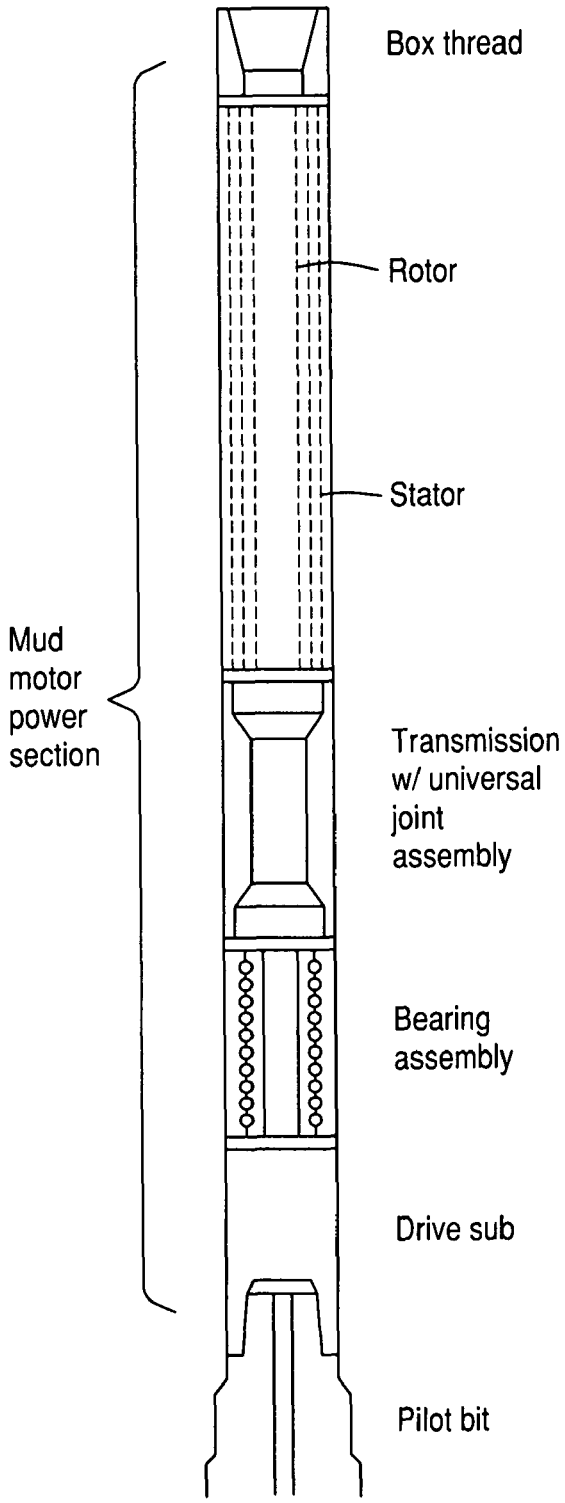
FIG. 2 illustrates a steerable mud motor/drill shown in FIG. 1*a*.
Figure 3:
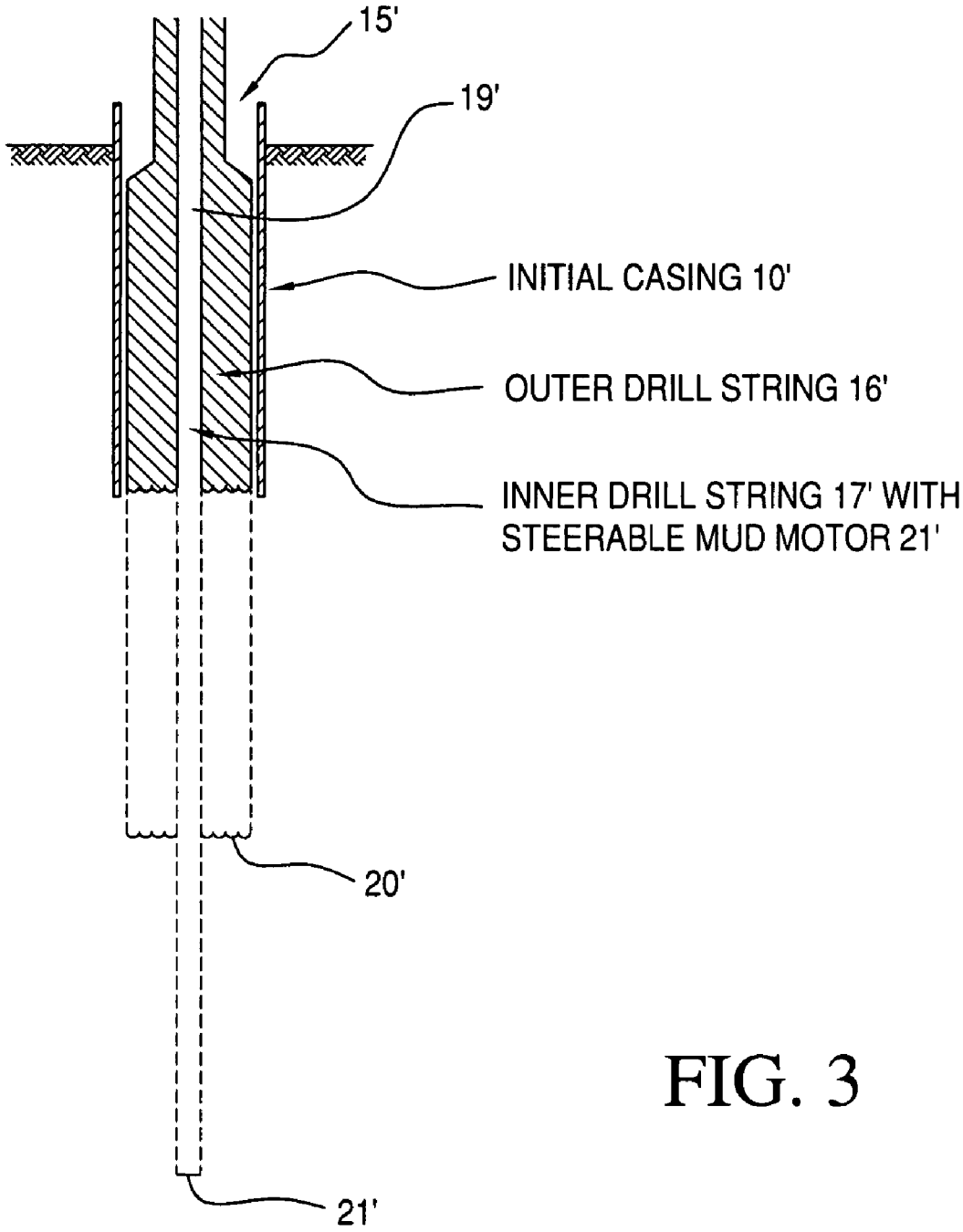
FIG. 3 is a schematic illustration of another aspect of the invention.

Referring now to FIG. 3, an initial cylindrical casing 10' is installed as the starter casing. It must be absolutely straight and then after it is placed it is emptied. Drill string assembly 15' comprised of an outer drill string 16' and an inner drill string 17' telescopically fitted in a bore 19 in the outer drill string 16'. Outer drill string 16', which may be several feet in diameter (4-6 feet) has its own drill bit array 20', at the lower end thereof. Inner drill string 17' is provided with a steerable mud motor/drill 21' (FIG. 2) which is commonly used in oil and gas well drilling and may be several inches in diameter (5-13 inches; preferably 12¼ inch). Drill string assembly 15' is lowered in the cylindrical casing 10' and set vertical. The next step is the inner drill string 17' is advanced to the full depth, being guided by the steerable mud motor/drill 21'. The inner and outer drill strings are provided with passages for the circulation of selected drilling fluids which remove the cuttings to the surface. After the inner drill string 17' and steerable mud motor/drill 21 have been advanced to the final depth, the outer drill string 16' is advanced by its own drive head (not shown in FIG. 3) all the while being guided by the pilot inner drill string 17'.

Step I

Install a starter casing 10' absolutely straight and empty it.

Step II

Lower the drill string assembly in the hole and again set it vertical.

Step II

Advance inner drill string 10'-20' using the steerable mud motor 21 to assure verticality.

Step IV

In the present embodiment, advance the outer drill string guided by the inner drill string.

Figure 4:
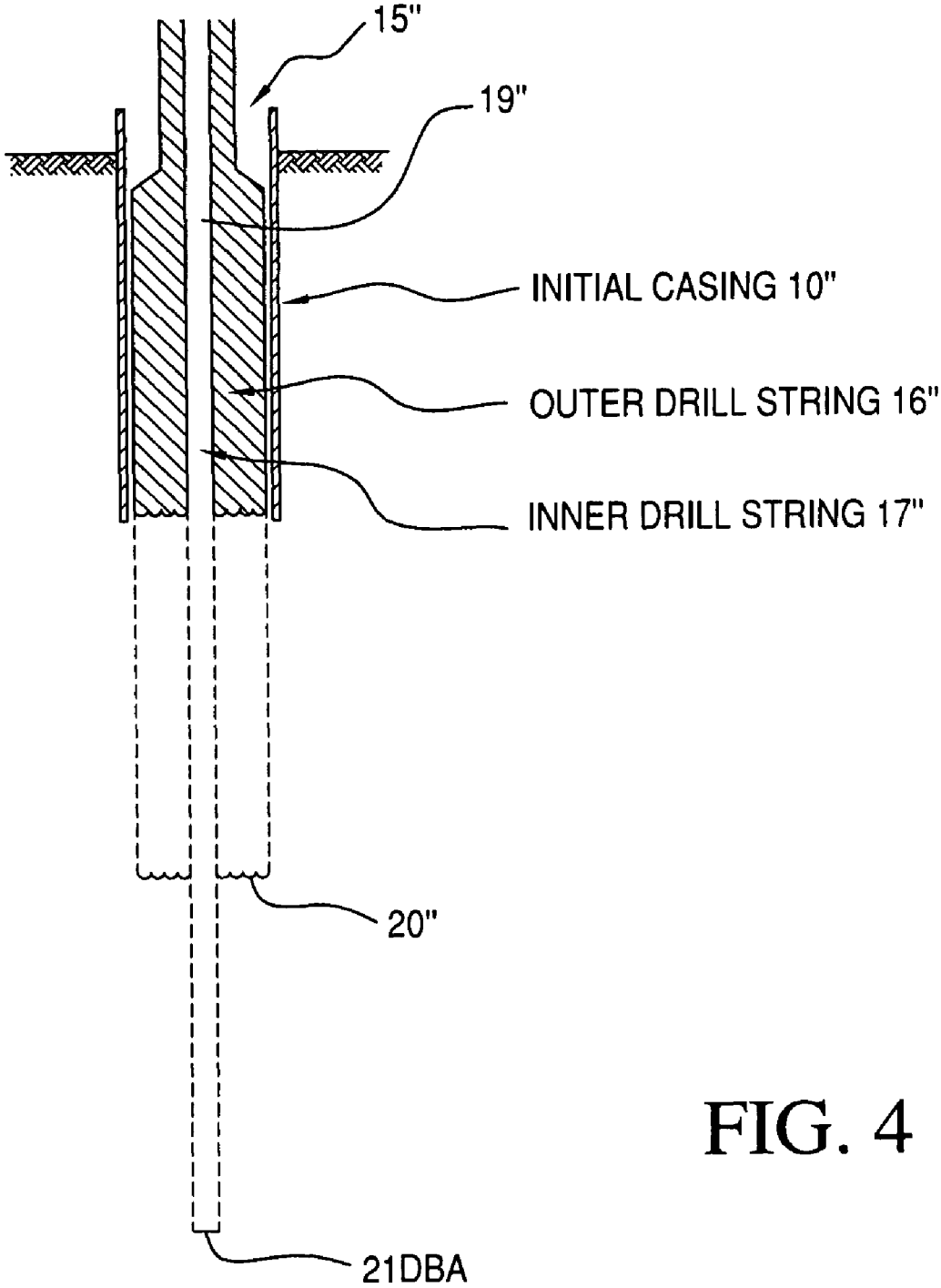
FIG. 4 is a schematic illustration of further aspects of the invention.

Referring now to FIG. 4, an initial cylindrical casing 10" is installed as the starter casing. It must be absolutely straight and then after it is placed it is emptied. Drill string assembly 15" comprised of an outer drill string 16" and an inner drill string 17" telescopically fitted in a bore 19" in the outer drill string 16". Each drill string 16"-17" has its own drill bit array 20", 21DBA, respectively, at the lower ends thereof. Drill string assembly 15" is lowered in the cylindrical casing 10" and set vertical. The next step in this embodiment is the inner drill string 17" is advanced by a drive head (not shown in FIG. 4) ten to twenty feet, being guided by the bore 19" in the outer drill string 16". The respective inner and outer drill strings are provided with passages for the circulation of selected drilling fluids which remove the cuttings to the surface. After the inner drill string 17" has been advanced, the outer drill string 16" is advanced by its own drive head all the while being guided by the pilot inner drill string 17". This process is repeated with new sections of inner and outer drill strings being added, to the final depth.

Summarizing

Step I

Install a starter casing 10' absolutely straight and empty it.

Step II

Lower the drill string assembly in the hole and again set it vertical.

Step III

Advance inner drill string for 10'-20', guided by the outer drill string.

Step IV

Advance the outer drill string guided by the pilot inner drill string.

Step V

Repeat process to final depth.

Drilling can be done by percussion, rotary percussion or rotary method with direct or reverse circulation using air or fluids.

Figure 5:
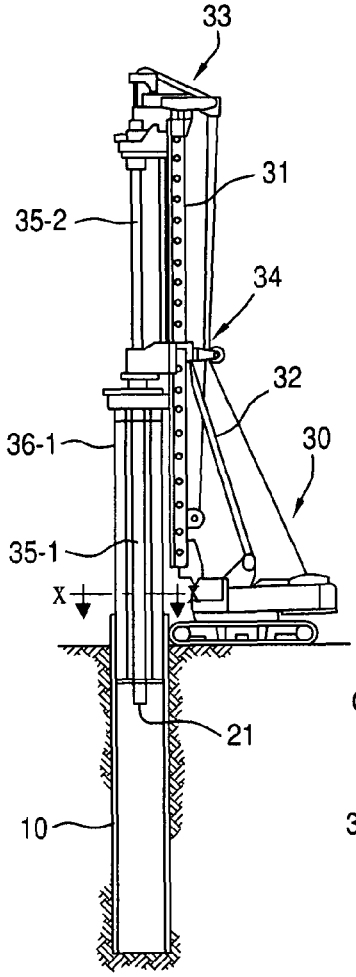
FIG. 5 illustrates in greater detail the cylindrical starter casing and the initial position of the drill string assembly.
Figure 6:
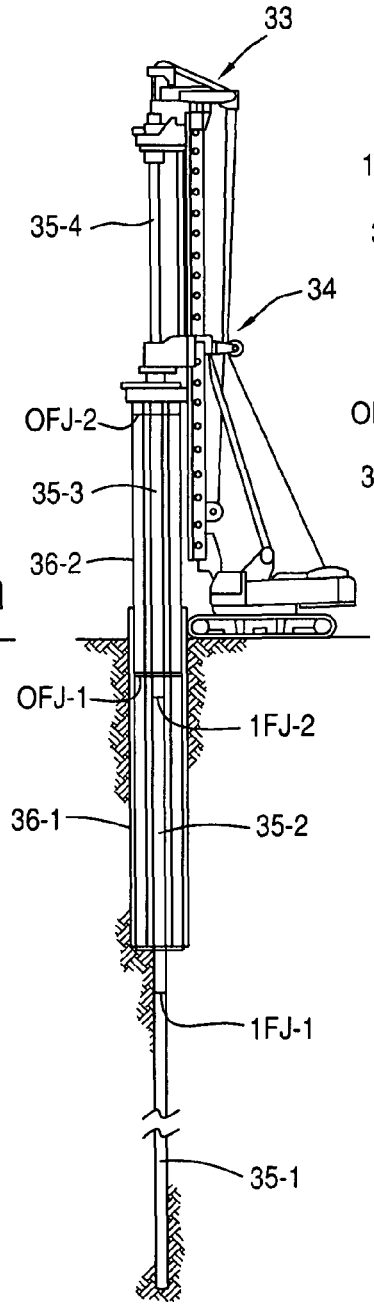
FIG. 6 is an illustration of the drill string assembly with inner drill string advanced to the full depth of the borehole.

Referring to FIG. 5, a mobile drill rig 30 (which can be used in any of the embodiments disclosed herein) having a mast 31 supported by a strut 32 for supporting drive head 33 coupled to the inner drill string 35 (35-1, 35-2) and drive head 34 couples to the outer drill string 36 (36-1). The drive heads 33 and 34 may include rotary tables and the like for rotating the respective inner and outer drill strings 35 and 36, respectively. (Inasmuch as the embodiments shown in FIGS. 1 and 3 incorporate steerable mud motors, rotary drive tables for the drill string are not necessary). As shown in FIG. 5, the drill string assembly is being lowered into the starter casing 10' which has been previously installed and verticalized. It should be noted that the inner drill string 35 is double the length of the outer drill easing string 36 being constituted by two inner drill string casings joined by the flush joints 1FJ-1 FIG. 6) to be described later. The inner and outer drill strings 35, 36 constituting the drill string assembly are lowered into the starter casing 10'. Referring to FIG. 6, it will be noted that three additional inner drill string section (35-2-35-4) and one additional outer drill string casing (36-2) have been added.

Figure 7:
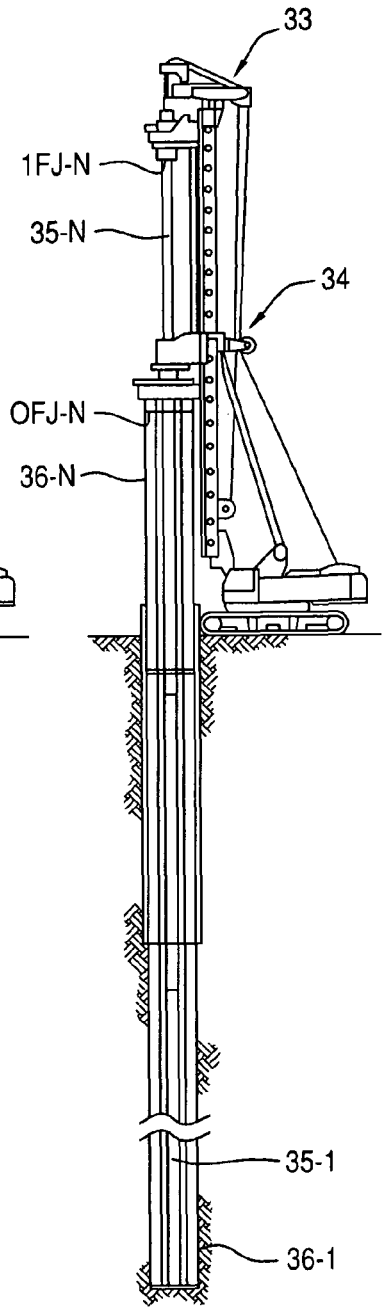
FIG. 7 illustrates the next phase of the process wherein the outer drill string has been advanced to the final depth of the borehole using the casing which has been placed in the small borehole as a verticality guide.

In FIG. 6, the lower most inner drill string is illustrated as having been operated and the outer drill string 36 is set to be operated and uses inner drill string section 35 as a verticality guide. Referring to FIG. 7, further (nth) sections of inner and outer drill string sections have been added and the process repeated therein. The case of FIG. 7, shows outer drill string 36 that will serve as a verticality guide for the inner drill string 35. It is noted that the inner and outer drill string sections have to be disconnected from their respective drill heads to allow the insertion of new sections of the outer and inner drill strings, respectively.

Each successive inner drill string section 35-1, 35-2 . . . 35-N is joined to the preceding section by flush joints 1FJ-1, 1FJ-2 . . . 1FJ-N so that inner drill string 35 smoothly telescope in the verticality guide in the outer drill string 36 sections. Likewise, each successive outer drill string sections are joined to preceding outer drill string sections by flush joints OFJ-1, OFJ-2 . . . OFJ-N.

The drilling can be done with air or fluids, direct or reverse circulation depending on soil conditions.

Figure 8:
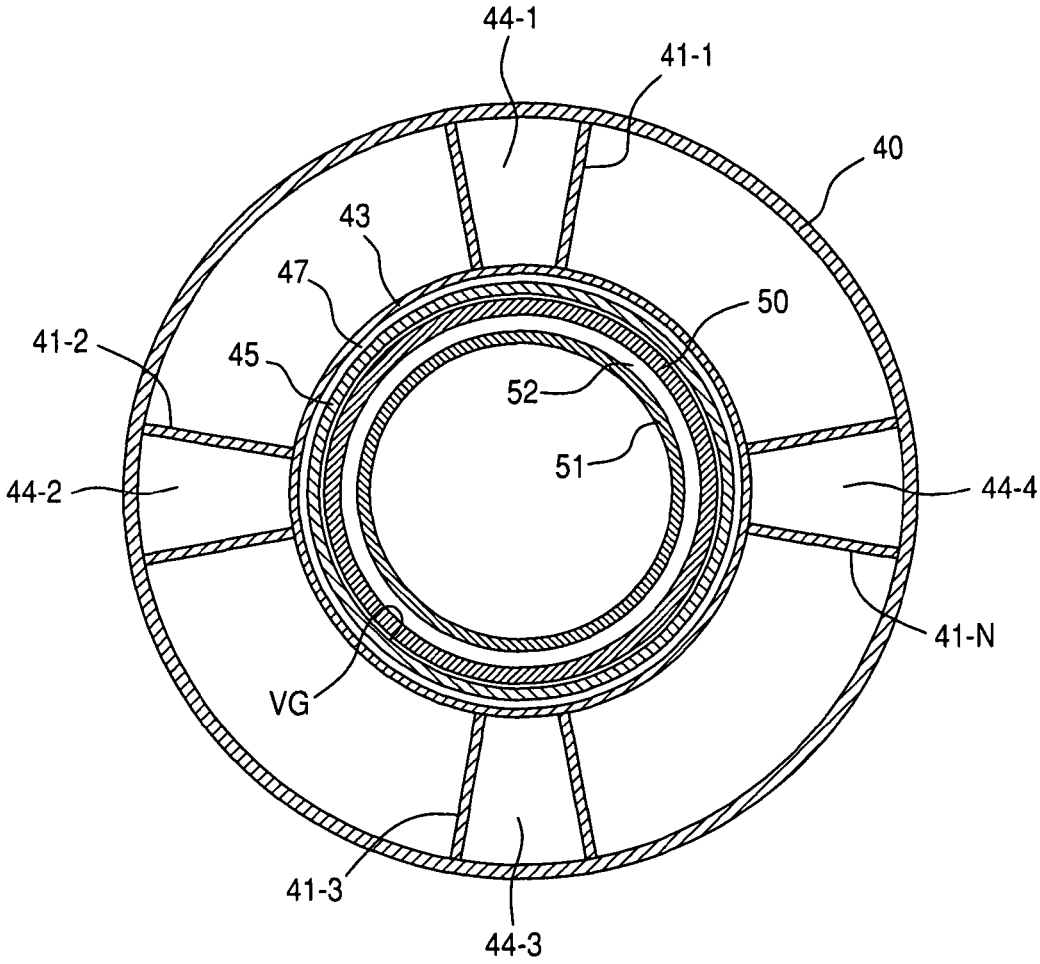
FIG. 8 is a sectional view of the typical drill string taken on line "X" of FIG. 5.

FIG. 8 is a section of the drill string assembly taken on section line "X" of FIG. 2. The outer drill string casing is comprised of an outer cylindrical shell 40 joined by duct channel struts 41-1, 41-2, 41-3 . . . 41-N to an inner cylindrical member 43, the struts 41 defining ducts 44-1,44-2, 44-3, 44-4 for arisings or cuttings and the excavation fluid used. Inner cylindrical member 45 is spaced from member 43 and defines an air duct 47 for the outer casing and defines a guide VG for the inner drill string assembly 35. The inner bore VG of member 45 defines the central guiding borehole for telescopingly receiving the inner drill string 35. The inner drill string 35 comprises an outer cylindrical member 50 joined to an inner cylindrical member 51 defining a duct 52 for arisings and cuttings for the inner drill string casing.

The invention can be used to make single deep vent holes for ventilation shafts in deep tunnels, water intakes and the like, deep secant pile walls for cut-offs and the like, and to make deep combination walls.

Figure 9:
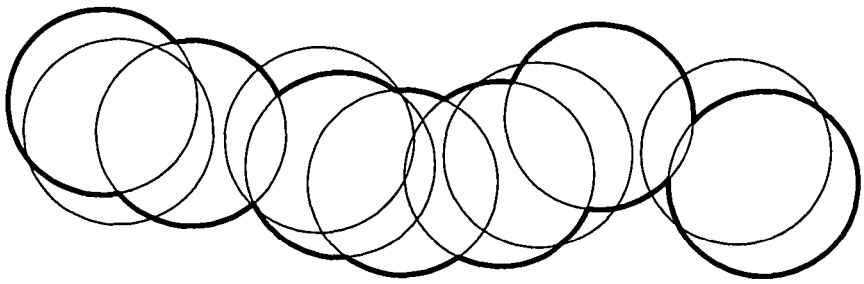
FIG. 9 is a plan view of a cut-off wall formed by intersecting bore piles with the spaced primary holes formed by the process disclosed herein.

In order to build a continuous wall as shown in FIG. 9 using the process described above, first verify the maximum deviation of the drilling system and space primary holes to guarantee minimum overlap of secondary holes assuming maximum deviation at full depth.

Figure 10:
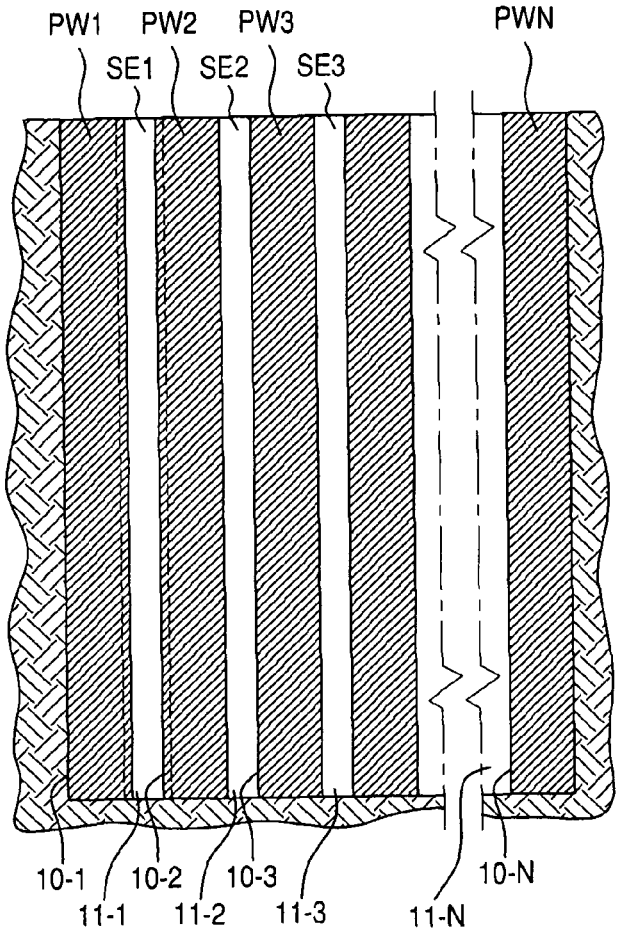
FIG. 10 is a vertical section of the primary elements of the palisade or cut-off wall.
Figure 11:
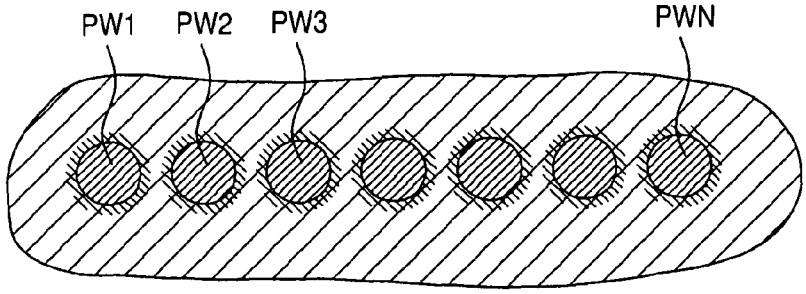
FIG. 11 is a plan view of the primary wall elements along the line of the cut-off wall.
Figure 12:
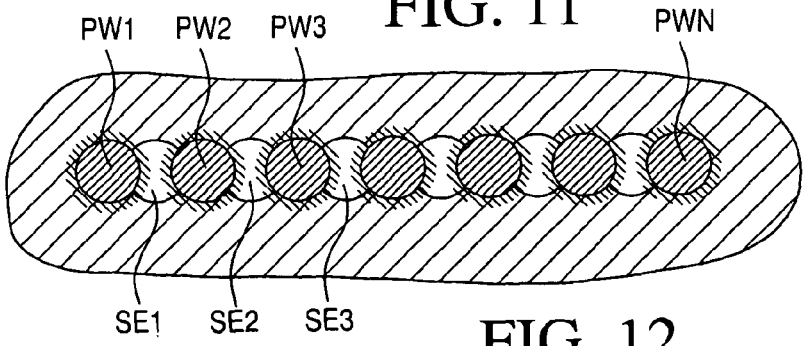
FIG. 12 is a plan view of the lay out of primary elements along the line of the cut-off wall with the overlapping positions of the secondary elements.

Referring to FIG. 10, a plurality of holes 10-1, 10-2, 10-3 and 10-N for primary wall elements PW1, PW2, PW3 and PWN are drilled into the ground by means of the novel methods disclosed herein or by a conventional large rotary drill bit having a bore in its center through which a thick liquid slurry is introduced into the hole and caused to circulate upwards within the hole in order to carry the material dug out from the bottom of the hole up to the surface and to obtain at the same time sealing and reinforcement of the wall excavation.

Figure 13:
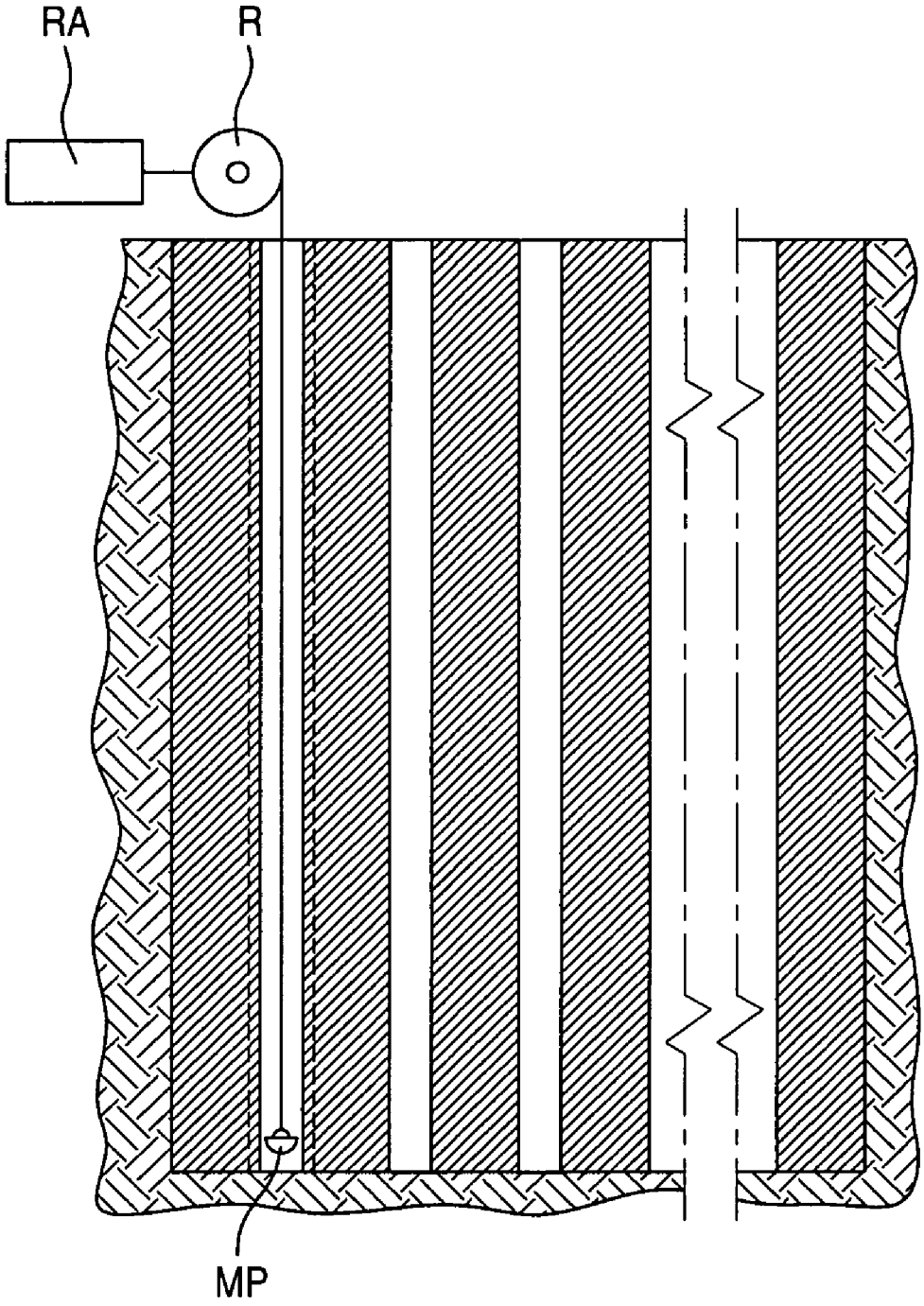
FIG. 13 is an illustration showing the magnetic borehole probe reading the magnetic properties of two adjacent primary elements.

The primary element holes 10-1, 10-2, 10-3 and 10-N are filled with wall forming material. The wall forming material (preferably cementous) fills the holes to form the primary wall elements PW1, PW2, PW3 and PWN of the cut-off wall and each contains a substance which can be sensed by a probe. Preferably the substance is a magnetic substance which is mixed with and uniformly dispersed in the wall forming material. The holes 11-1, 11-2, 11-2 and 11-N for the secondary elements SE1, SE2, SE3 are excavated forming secant joints with the primary elements by removing portions thereof. The starts of the secondary holes are positioned to maximize the overlap. After excavation of the holes for the secondary elements, a magnetic borehole probe MP (FIG. 13) is lowered from a reel R into each secondary excavation before filling with wall forming material. The probe MP is connected to a recording analyzer RA which will record the portion of the periphery of the secondary holes with magnetic material from the primary wall elements PW1, PW2, PW3 and PWN. When a dicontinuity is detected, remedial action may be taken, such as enlarging the diameter of the secondary elements or reaming the hole for the second element to eliminate the discontinuity. Another remedial method is to drill an additional overlapping hole, check with the magnetic probe and fill the hole with concrete to correct for the misalignment and eliminate the discontinuity. By continuing this process any desired number of times, a completely watertight cut-off wall is obtained.

The result of this is a compact palisade or cut-off wall. According to above description of the construction, the individual holes 10-1, 10-2, 10-3 and 10-N of the entire series of holes may be drilled in consecutive order. It is obvious that one will not go out of the scope of the invention if the order of drilling the holes is modified; the same discontinuity detection principle is applied when the primary elements are in the form of elongated shapes excavated by a Hydromill for example as shown in Miotti U.S. Pat. No. 5,056,242.

The invention claimed is:

1. A method of constructing a cut-off wall, comprising the steps of:

excavating a small diameter vertical borehole in the earth and installing a casing in said small diameter vertical borehole;

excavating a large diameter vertical borehole coaxially with said small diameter vertical borehole using said casing as a verticality guide, and as a tremie pipe;

filling said large diameter vertical borehole in the earth with a wall forming material;

removing said casing from said large diameter vertical borehole;

excavating a second small diameter vertical borehole in the earth and installing the casing in said second small diameter vertical borehole;

excavating a second large diameter vertical borehole coaxially with said second small diameter vertical borehole using said casing as a verticality guide, and as a tremie pipe, the second large diameter vertical borehole being spaced such that the outer perimeter of said second large diameter borehole is spaced a distance less than the diameter of said large diameter vertical borehole away from the outer perimeter of said large diameter vertical borehole;

filling said second large diameter vertical borehole with a wall forming material removing said casing from said second large diameter vertical borehole; and excavating at least a third large diameter vertical borehole in secant intersecting relation to said first and second large diameter boreholes, respectively, and filling said third large diameter vertical borehole with a wall forming material and repeating the steps already recited, at least one further time, wherein:

said small diameter vertical boreholes are excavated using a steerable mud motor excavator; and said wall forming material contains a detectable substance, and a probe for detecting said detectable substance is lowered in said third large diameter vertical borehole to detect said detectable substance in said secant intersecting relations.

2. The method defined in claim 1, wherein:

said small diameter vertical borehole is excavated in alternating increments of depth with excavation of said large diameter borehole proceeding in a leap-frog fashion relative to the excavation of said small diameter vertical borehole using said casing a verticality guide.

3. The method of constructing a cut-off wall as defined in claim 1, wherein:

said detectable substance is a magnetic substance.

* * * * *